United States Patent [19]

Culbreath

[11] Patent Number: 4,875,401

[45] Date of Patent: Oct. 24, 1989

[54] MOUTHPIECE PLATES OF FLUTE-TYPE WIND INSTRUMENTS

[76] Inventor: J. Charles Culbreath, 2008 Cloverdale Ave., Winston-Salem, N.C. 27103

[21] Appl. No.: 238,469

[22] Filed: Aug. 31, 1988

[51] Int. Cl.[4] ..... G10D 7/02
[52] U.S. Cl. ..... 84/384
[58] Field of Search ..... 84/384

[56] References Cited

U.S. PATENT DOCUMENTS

| | | | |
|---|---|---|---|
| 1,704,147 | 3/1929 | Paulson | 84/383 |
| 2,637,239 | 5/1953 | Swanson | 84/384 |
| 3,062,084 | 11/1962 | Ogilvie | 84/384 |
| 3,599,526 | 8/1971 | Sollecito | 84/384 |
| 4,550,637 | 11/1985 | Drelinger | 84/384 |

FOREIGN PATENT DOCUMENTS

| | | | |
|---|---|---|---|
| 351758 | 4/1922 | Fed. Rep. of Germany | 84/384 |

OTHER PUBLICATIONS

Sankyo Flutes Publication (undated) in Japanese Language

*Primary Examiner*—Lawrence R. Franklin
*Attorney, Agent, or Firm*—Wigman & Cohen

[57] ABSTRACT

A mouthpiece plate for a flute-type wind instrument is disclosed. The mouthpiece plate or a portion thereof is pivotable or movable to provide for incremental adjustments of the movable portion to assist the flutist in establishing the optimum embouchure for his or her facial skeletal and muscular characteristics. In an alternative embodiment, the mouthpiece plate is fixed but has a shape which provides stability for the instrument and aids in establishing optimum embouchure.

16 Claims, 3 Drawing Sheets

MOUTHPIECE PLATES OF FLUTE-TYPE WIND INSTRUMENTS

FIELD OF THE INVENTION

The present invention relates to musical wind instruments of the flute-type and more particularly to improvements in the mouthpiece plates of flute-type wind instruments. As used herein the term "flute" is intended to include all musical instruments of the flute family, such as flutes, piccolos, fifes and the like. The term "embouchure" as used herein refers to the manner in which the chin, lips and tongue are applied to the mouthpiece of such instrument.

DESCRIPTION OF THE PRIOR ART

Typically, the mouthpiece plate of a conventional flute has an essentially standard or universal configuration comprising a generally oval metal plate formed into a curved or arcuate shape concentric to the diameter of the headjoint of the flute tube and provided with a blow hole. U.S. Pat. No. 4,550,637 to Drelinger describes and illustrates the conventional structure of a mouthpiece plate and a method of attaching the same to a flute headjoint. The disclosure of the Drelinger patent is incorporated herein by reference.

A prerequisite to the development of the ability of an individual to skillfully perform on a flute instrument is the establishment for that individual of the correct embouchure or the proper placement of the chin, lower lip and tongue with respect to the mouthpiece plate and the blow hole. Because of the almost infinite variations in the facial skeletal and muscular systems of individual flutists, some of which result from differences in sex, age, weight, race, etc., the proper positioning or embouchure of the chin, lips and tongue with respect to the mouthpiece is likely to vary to some extent for each flutist. Similarly, a musician who learns the flute at an early age and continues to perform into adulthood experiences natural changes in the facial skeletal and muscular systems which require adjustment in the musician's embouchure.

If a beginning flutist encounters great difficulty in finding the proper embouchure with a conventional flute with a fixed mouthpiece, he or she may be discouraged from continuing to learn the instrument. Likewise, an individual who has the ability to become an accomplished flutist may never reach his or her full potential because that individual's facial skeletal and musculature may preclude optimum embouchure with a conventional flute mouthpiece. Accordingly, it would be highly advantageous to provide a means by which the mouthpiece of a flute may be adjusted to achieve optimum embouchure for the individual flutist, regardless of variations in facial skeletal and musculature or differences in sex, age, weight, race or the like of the flutist.

It is known in the art to provide permanent or detachable mouthpiece devices, particularly for use by beginning flutists, to assist in locating the proper embouchure or placement of the lips in relation to the mouthpiece. U.S. Pat. Nos. 2,637,239 to Swanson and 3,599,526 to Sollecito et al disclose such prior art devices.

U.S. Pat. No. 1,704,147 to Paulson discloses a flute mouthpiece comprising an elongate absorbent body with a longitudinal passage. The body is mounted for pivotable movement so as to change the direction of the air current with respect to the blow hole of the instrument. The body is absorbent for the purpose of absorbing the moisture in the breath of the flutist. A disadvantage of this device is that it is cumbersome and presents an unusual appearance uncharacteristic of a flute-type instrument. In addition, in order to produce a flute sound, it is important that breath be blown across the blow hole. The Paulson device does not contemplate that the mouth will be positioned near the blow hole, but spaced therefrom.

None of the prior art devices provide a mouthpiece mechanism for a flute having means for making incremental adjustments in an arcuate mouthpiece plate or a portion thereof relative to the fixed blow hole in the flute headjoint.

SUMMARY OF THE INVENTION

In view of the limitations and shortcomings of the prior art devices as mentioned above, as well as other disadvantages not specifically enumerated, it should be apparent that there still exists a need in the art for an improved flute mouthpiece plate which is adjustable in such manner as to assist the flutist in forming proper embouchure. It is, therefore, a principal object of the present invention to fulfill that need by providing a headjoint for a flute with an arcuate mouthpiece plate which is articulatable in whole or in part relative to the blow hole of the flute.

It is an object of an alternative embodiment of this invention to provide a fixed mouthpiece plate design which provides greater support for the lower lip of the flutist and enables better "bracing" and stability of the mouthpiece plate and thereby improved embouchure.

Briefly described, according to one embodiment of the invention, a mouthpiece plate of substantially conventional shape, i.e., an oval plate formed into an arcuate shape, is made in two portions, a first plate portion of which is fixed to the headjoint of the flute and the second plate portion of which is hinged to the first portion so as to be movable or pivotable about an axis substantially parallel to the longitudinal axis of the flute. A mechanism is provided for incrementally moving or pivoting the second plate portion relative to the first plate portion from one fixed position to another fixed position.

The second embodiment of the invention is a modified form of the first embodiment. Substantially the entire mouthpiece plate is hinged to the chimney tube or stack surrounding the blow hole along an axis substantially parallel to the longitudinal axis of the flute.

According to a third embodiment of the invention, the mouthpiece plate is similar to that of the second embodiment, except that it is separate from the chimney tube and is movable up and down relative thereto. In the third embodiment, the mouthpiece plate may also be tilted to a limited extent about a plurality of axes parallel to the longitudinal axis of the flute in a manner similar to the movement of the mouthpiece plate of the second embodiment.

Another object of the present invention is to provide a means for altering the configuration of the mouthpiece plate of a flute-type instrument without altering the traditional appearance of the instrument.

By means of the above-described adjustment of the mouthpiece plate of the invention, the flutist, whether a beginner or an accomplished musician, may position the mouthpiece plate to form the optimum embouchure for his or her particular facial characteristics, training, experience, comfort, etc.

In another form of the invention, the mouthpiece plate is fixed to the headjoint of the flute in a conventional manner, but is shaped to provide a ledge or shelf portion extending in a plane generally tangentially to the arc of curvature of the mouthpiece plate and a lip portion depending at substantially a right angle from the ledge or shelf portion. This arrangement permits the flutist to brace the flute into the lower lip cleft between the mouth and chin and provides stability so that the flutist may "brace" the mouthpiece plate and form the embouchure with greater support for the lower lip.

BRIEF DESCRIPTION OF THE DRAWINGS

With the foregoing objects and other objects, advantages and features of the invention that will become hereinafter apparent, the nature of the invention may be more clearly understood by reference to the following detailed description of the invention, the appended claims and to the several views in the attached drawings, in which:

DETAILED DESCRIPTION OF THE INVENTION

Figure 1:
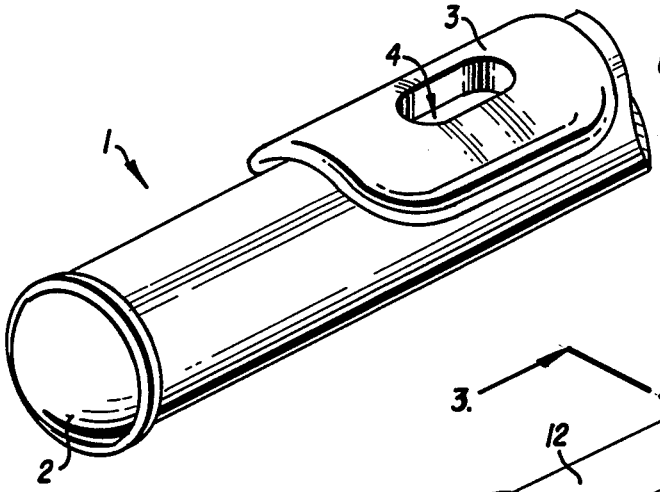
FIG. 1 (PRIOR ART)
FIG. 1 is a perspective view of the headjoint of a flute showing a conventional mouthpiece.

Referring now in detail to the drawings, a conventional prior art flute-type instrument headjoint is illustrated in FIG. 1 and is designated generally with reference numeral 1. As shown, the headjoint 1 is closed at one end 2 and open at the other end (not shown) for connection to the instrument body, such as a flute, piccolo, fife or the like. A mouthpiece plate 3 is affixed to the headjoint in a conventional manner, for example, by soldering, and a blow hole 4 is provided through mouthpiece plate 3 and the cylindrical tubular wall of the headjoint 1. The construction details of the headjoint 1 are illustrated and described, as previously mentioned, in U.S. Pat. No. 4,550,637.

Figure 2:
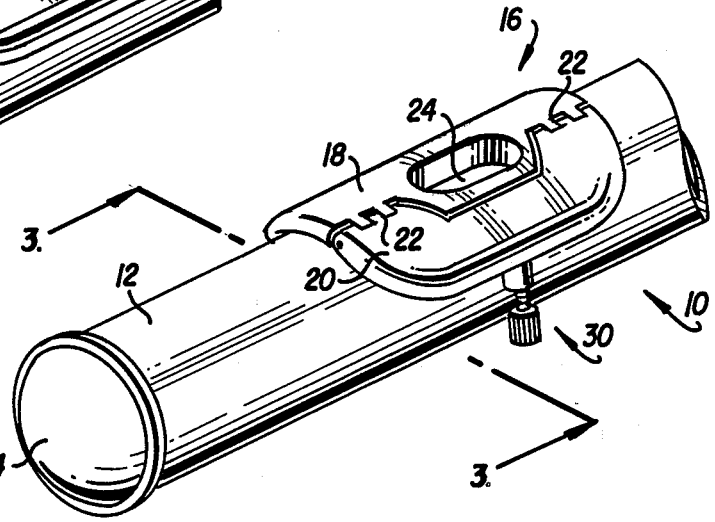
FIG. 2 is a perspective view of a flute headjoint illustrating a first embodiment of the mouthpiece plate of the present invention.
Figure 3:
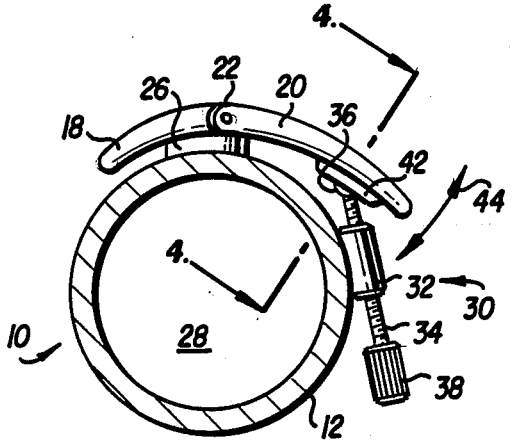
FIG. 3 is a cross-sectional view of the first embodiment taken along plane 3—3 of FIG. 2.
Figure 4:
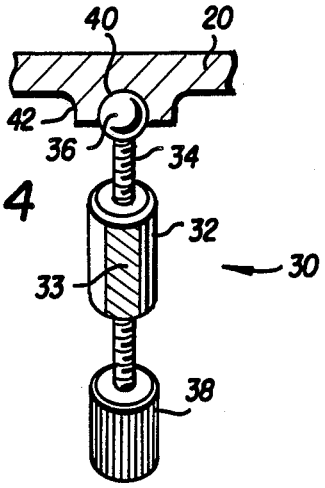
FIG. 4 is a fragmentary cross-sectional view of the first embodiment taken along plane 4—4 of FIG. 3 illustrating the adjustment mechanism for the mouthpiece plate of FIG. 2.

Now referring to the first embodiment of the invention illustrated in FIGS. 2–4, a headjoint 10 comprising a tubular body 12 with a closed end 14 is substantially identical to the headjoint 1 of FIG. 1. The mouthpiece plate designated generally with reference numeral 16 is formed in two portions, a first plate portion 18 is fixed to the headjoint body 12 and a second plate portion 20 is pivotally mounted to the first plate portion 18 by means of hinge connections 22 in a manner similar to a flap on an aircraft airfoil. The pivot axis of the hinge connections 22 is substantially parallel to the longitudinal axis of the headjoint body 12. Preferably, the hinge connection is designed for minimal interruption in the mouthpiece plate surface.

A blow hole 24 is formed through the first plate portion 18 of mouthpiece plate 16 and extends through the chimney or stack 26 (FIG. 3) and the tubular wall of the body 12 into the interior space 28 of the headjoint. In the preferred arrangement as shown in FIG. 2, the blow hole 24 is located entirely in the fixed plate portion 18, partly in a trapezoidally-shaped part of plate portion 18.

Means 30 (FIG. 4) are provided for adjusting the angle of attack or angular position of the second plate portion 20 to a position best suited for the flutist to establish optimum embouchure. The adjustment means 30 comprises a tubular barrel 32 formed of a metal or metal alloy and soldered or otherwise affixed to the exterior wall of the headjoint body 12 at the surface 33 thereof shown in cross-hatching in FIG. 4. The axis of barrel 32 is preferably arranged tangential to the circumference of the body 12 although other orientations are possible. Barrel 32 has an internally threaded bore into which an adjustment screw 34 is threaded.

As best shown in FIGS. 3 and 4, the adjustment screw 34 has a ball 36 affixed to one end thereof and a knob 38 affixed to the other end thereof with a fluted, knurled or otherwise roughened surface to aid in gripping the knob 38 with the fingers for manually rotating the screw 34. Preferably, the fit between the threads of the bore and screw is relatively tight so that the angular position of the screw relative to the barrel remains fixed once it is set by the flutist and is prevented from rotation by normal handling, vibration and the like. The ball 36 fits in a semicylindrical, elongated groove 40 in a manner similar to a ball and socket connection. Groove 40 is formed in an embossment 42, preferably integrally formed on the underside of the second or movable plate portion 20.

It should now be apparent to those skilled in the art that rotation of the knob 38 will change the angular position of plate portion 20 by causing it to pivot up or down about the axis of hinges 22 along an arc denoted by reference numeral 44 in FIG. 3.

Figure 5:
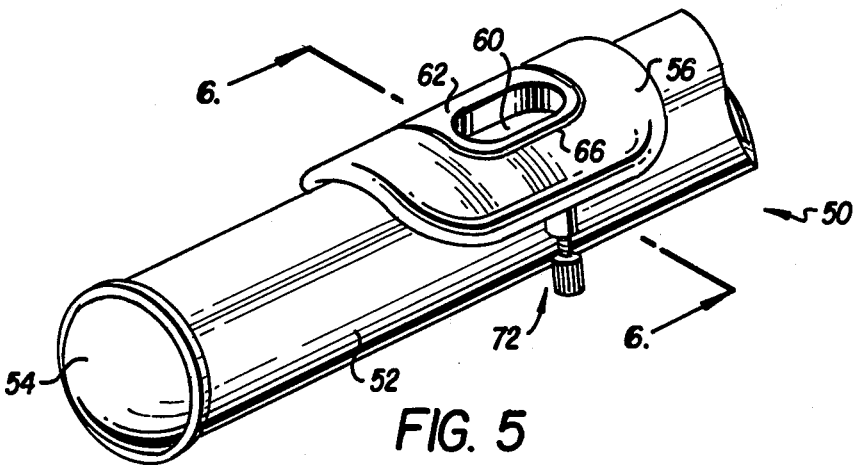
FIG. 5 is a perspective view of a flute headjoint illustrating a second embodiment of the mouthpiece plate of the present invention.
Figure 6:
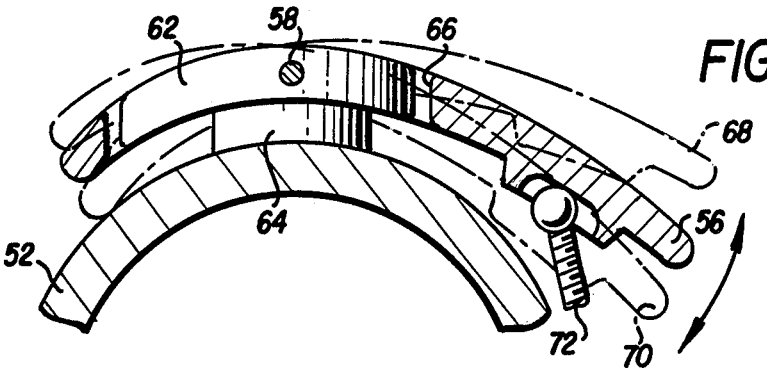
FIG. 6 is a fragmentary cross-sectional view of the second embodiment taken along plane 6—6 of FIG. 5.

The second embodiment of the invention illustrated in FIGS. 5–6 is similar to that of FIGS. 2–4 except that substantially the entire mouthpiece plate is pivotable about an axis parallel to the longitudinal axis of the flute headjoint. Thus, headjoint 50 comprises a tubular body 52 with a closed end 54 and a mouthpiece plate 56, which is pivoted about a pivot axis 58 (FIG. 6) and parallel to the flute longitudinal axis. The central portion of the mouthpiece surface surrounding the blow hole 60 comprises a plate 62 preferably soldered to a chimney or stack 64 in the conventional manner. An opening 66 in the mouthpiece plate 56 accommodates the central plate 62 and has an internal perimeter spaced a sufficient distance from the external perimeter of the plate 62 so as to permit the mouthpiece plate 56 to be pivoted to the extreme upper and lower positions shown in phantom in FIG. 6 and identified respectively with reference numerals 68 and 70. Preferably, that portion of plate 62 on the side of the blow hole away from or opposite "lip side" has a greater surface area (see FIG. 6) for proper air flow.

Means 72 are provided for adjusting the mouthpiece plate 56 to any position between the extreme upper and lower positions 68, 70. Adjustment means 72 are identical to adjustment means 30 of the first embodiment and therefore need not be described further herein.

Figure 7:
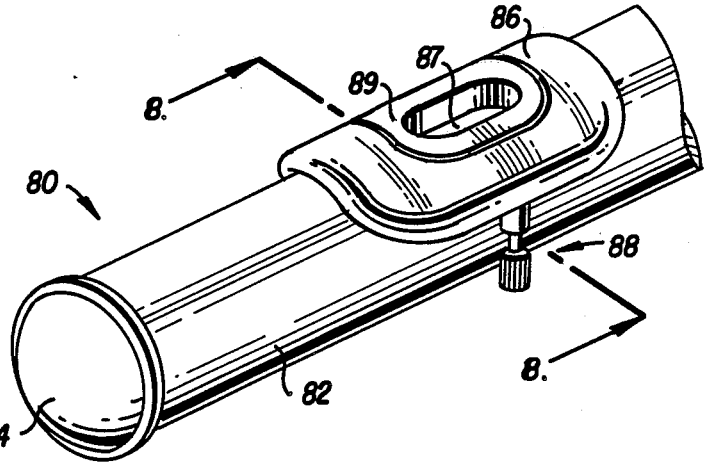
FIG. 7 is a perspective view of a flute headjoint illustrating a third embodiment of the mouthpiece plate of the present invention.
Figure 8:
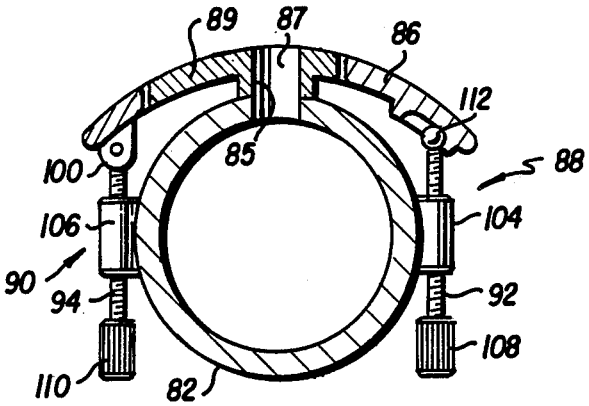
FIG. 8 is a cross-sectional view of the third embodiment taken along plane 8—8 of FIG. 7.
Figure 9:
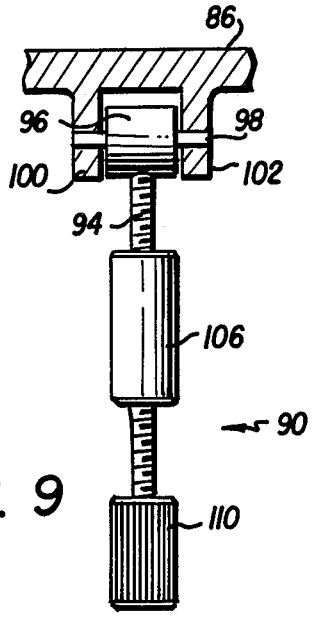
FIG. 9 is a fragmentary cross-sectional view of the third embodiment illustrating one of the adjustment mechanisms for the mouthpiece plate of FIG. 7.

Referring now to the third embodiment of the invention shown in FIGS. 7–9, there is shown a headjoint 80 comprising a tubular body 82 with a closed end 84 and a mouthpiece plate 86 similar in structure to mouthpiece plate 56 of the second embodiment of FIGS. 5–6 and a blow hole 87. However, instead of being pivoted along a single axis as in the first and second embodiments, mouthpiece plate 86 is articulatingly connected to the body 82 by two adjustment means 88, 90 disposed on diametrically opposite sides of the body 82 as best seen in FIG. 8. Adjustment means 88 is identical to adjustment means 30 and 72 of the first and second embodiments except that the axis of adjustment screw 92 is parallel to the air column axis through blow hole 87.

Adjustment means 90 is similar to adjustment means 88 except for the connection between the underside of mouthpiece plate 86 and adjustment screw 94. As best shown in FIG. 9, the connection between screw 94 and mouthpiece plate 86 comprises a cylindrical boss 96 affixed to the end of screw 94 which is pivotally connected by a pin 98 between a pair of ears 100,102 depending from the underside of plate 86. Barrels 104,106 are soldered or otherwise affixed to opposite sides of body 82 so that the axes of adjustment of screws 92,94 are parallel.

To adjust mouthpiece plate 86 to the optimum embouchure, the knobs 108,110 of adjustment means 88,90 are rotated a desired amount to suit the flutist. Unlike the first and second embodiments, however, the mouthpiece plate 86 of the third embodiment may be raised and lowered in a direction parallel to the axes of the screws 92,94 and the axis of blow hole 87, in other words, in a vertical direction as viewed in FIG. 8.

In addition, the mouthpiece plate may be pivoted about a plurality of axes from the axis of pivot pin 98 to the axis of ball 112. For instance, if knob 108 is rotated and knob 110 is not rotated, plate 86 will be pivoted about the axis of pin 98. Similarly, if knob 110 is rotated and knob 108 is not, plate 86 will be pivoted about ball 112. If knobs 108 and 110 are rotated in opposite directions an equal angle or an equal number of turns, plate 86 will be pivoted about an axis through its midplane which passes through the longitudinal axis of the headjoint. On the other hand, if knobs 108 and 110 are rotated in the same direction an equal angle or an equal number of turns, plate 86 will not pivot, but will move up or down parallel to the axes of screws 92,94. By varying the direction of rotation and number of turns of each screw 92, 94, the plate 86 can be articulated in any desired manner including a combination of pivoting and raising or lowering.

Chimney 85 and central plate 89 are substantially identical to the chimney 64 and central plate 62 of the second embodiment.

Figure 10:
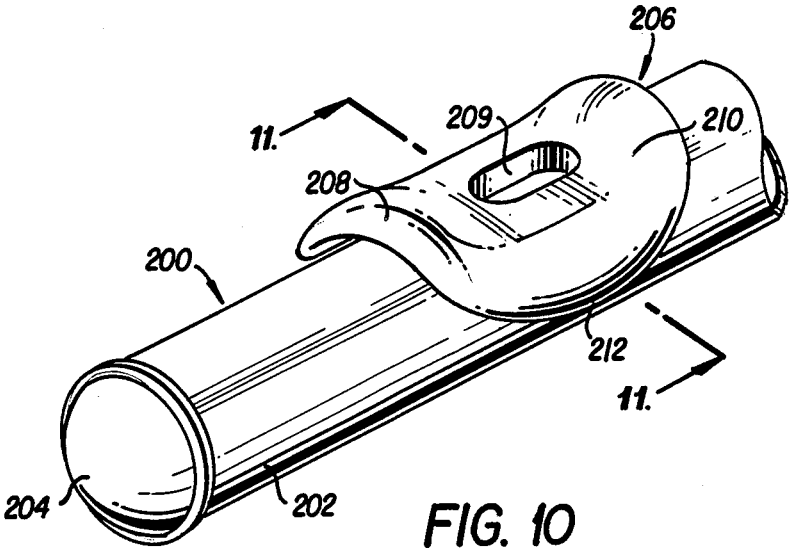
FIG. 10 is a perspective view of a flute headjoint illustrating another embodiment of the mouthpiece plate of the invention.
Figure 11:
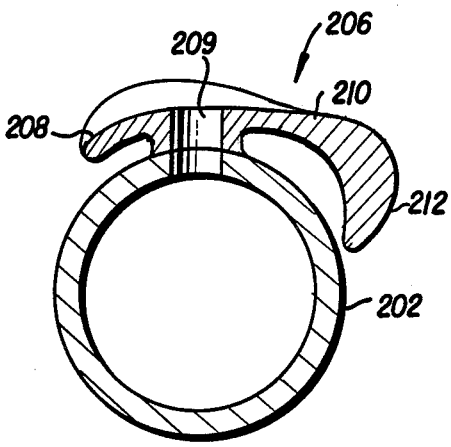
FIG. 11 is a cross-sectional view of the FIG. 10 embodiment illustrating the configuration of the mouthpiece plate along plane 11—11 of FIG. 10.

The embodiment of the present invention shown in FIGS. 10–11 differs from the previous embodiments in that the mouthpiece plate is fixed rather than articulatable. In this embodiment, the headjoint 200 comprises a tubular body 202 with a closed end wall 204 and a mouthpiece plate 206 soldered or otherwise affixed thereto in a conventional manner.

Mouthpiece plate 206 differs in shape from those of the prior art. As shown in FIGS. 10–11, one portion 208 of the mouthpiece plate corresponds to a conventional design with blow hole 209, the other portion comprises a shelf or ledge member 210 with a curved lip 212 depending downwardly from shelf member 210 at about a right angle. The top surface of shelf member 210 may be substantially planar as shown and extends in a plane substantially parallel to a plane tangential to the tubular body at the central axis of the blow hole 209.

In use, the bulbous transition formed between the shelf member 210 and the depending lip 212 is pressed into the lower lip cleft between the mouth and chin of the flutist to provide stability and permit the flutist to form a embouchure with greater support for the lower lip.

While all embodiments of the mouthpiece of the invention are shown and illustrated as being fabricated of metal, the mouthpieces of all embodiments of the invention could also be made of a plastic material, such as by molding. A molded plastic mouthpiece is particularly advantageous for the embodiment of FIGS. 10–11 because of the compound curves of that embodiment.

Although only preferred embodiments are specifically illustrated and described herein, it will be appreciated that many modifications and variations of the present invention are possible in light of the above teachings and within the purview of the appended claims without departing from the spirit and intended scope of the invention.

What I claim is:

1. In a musical instrument of the flute-type comprising a headjoint with a longitudinal axis, said headjoint having a blow hole and an arcuate mouthpiece plate surrounding said blow hole, the improvement comprising at least a portion of said mouthpiece plate being movable relative to said headjoint and means connected between said headjoint and the movable portion of said mouthpiece plate for adjusting the position of said movable portion whereby adjustment of said movable portion aids the user of said instrument to establish optimum embouchure.

2. The improvement according to claim 1, wherein said movable portion is pivotable about a pivot axis substantially parallel to the longitudinal axis of said headjoint.

3. The improvement according to claim 2, wherein said blow hole has an axis, said movable portion being further movable in a direction substantially parallel to the blow hole axis.

4. The improvement according to claim 3, wherein said headjoint comprises a tubular body, said adjustment means comprising first and second connections at the movable portion of the mouthpiece plate on opposite sides of the blow hole and third and fourth connections at the tubular body associate respectively with the first and second connections and first and second means for varying the distance between the first and third connections and between the second and fourth connections, respectively.

5. The improvement according to claim 4, wherein said first connection is a ball guided in an elongated groove disposed on the underside of the movable portion and said second connection is a pivot pin connected to a pair of depending ears on the underside of the movable portion, said first and second distance varying means comprising a pair of adjustment screws, said ball being affixed to an end of one screw and said pivot pin being pivoted to an end of the other screw.

6. The improvement according to claim 5, wherein said third and fourth connections each comprise barrels affixed to the circumference of said tubular body and each having a threaded bore, said adjustment screws being threaded into a respective one of said bores.

7. The improvement according to claim 5, wherein the axes of adjustment of said adjustment screws are parallel to each other and to the blow hole axis.

8. The improvement according to claim 2, wherein said mouthpiece plate is formed in two portions, a first portion being fixed to the headjoint and a second portion being pivotable relative to said headjoint.

9. The improvement according to claim 8, wherein said second portion is hinged to said first portion at two points spaced along said pivot axis, said adjustment means being connected between the underside of the second portion and the headjoint.

10. The improvement according to claim 2, wherein said mouthpiece plate is pivotable about an axis passing through the blow hole.

11. The improvement according to claim 2, wherein said headjoint comprises a tubular body, said adjustment means comprising a first connection at the movable portion of the mouthpiece plate and a second connection at the tubular body of the headjoint, and means for varying the distance between said first and second connections.

12. The improvement according to claim 11, wherein said first connection comprises a ball guided in an elongated groove disposed on the underside of said movable portion, said distance varying means comprising an adjustment screw, said ball being affixed to one end of said screw.

13. The improvement according to claim 12, wherein said second connection comprises a barrel affixed to the circumference of said tubular body and having a threaded bore, said adjustment screw being threaded into said bore.

14. The improvement according to claim 13, including a knob on the outer end of said adjustment screw for manual adjustment of said adjusting means.

15. The improvement according to claim 1, wherein said blow hole comprises a chimney extending upwardly through said mouthpiece plate, a central fixed plate with an upper surface fixed to said chimney, said upper surface having a curvature substantially coterminous with the curvature of said mouthpiece plate.

16. The improvement according to claim 15, wherein the upper surface of said central plate has a greater surface area on the side of said blow hole opposite the side at which the lips of the user are placed.

* * * * *